United States Patent [19]

Amano

[11] Patent Number: 4,653,384

[45] Date of Patent: Mar. 31, 1987

[54] AIR SUPPLY ADJUSTING MECHANISM FOR AIR CONDITIONER

[75] Inventor: Masao Amano, Shizuoka, Japan

[73] Assignee: Kabushiki Kaisha Toshiba, Kawasaki, Japan

[21] Appl. No.: 815,051

[22] Filed: Dec. 31, 1985

[51] Int. Cl.[4] ..... F24F 13/14

[52] U.S. Cl. ..... 98/40.3; 98/40.24; 98/110

[58] Field of Search ..... 98/2, 40.12, 40.17, 98/40.24, 40.3, 94.2, 110, 121.2

[56] References Cited

U.S. PATENT DOCUMENTS

| | | | |
|---|---|---|---|
| 2,293,065 | 8/1942 | Kiczales | 98/110 |
| 3,017,899 | 1/1962 | Goldsmith et al. | 98/110 X |
| 3,308,739 | 3/1967 | Gygax | 98/40.24 X |
| 3,783,768 | 1/1974 | Caming et al. | 98/110 |

FOREIGN PATENT DOCUMENTS

| | | | |
|---|---|---|---|
| 56-21162 | 2/1981 | Japan . | |
| 737722 | 5/1980 | U.S.S.R. | 98/40.12 |

*Primary Examiner*—Harold Joyce

*Attorney, Agent, or Firm*—Cushman, Darby & Cushman

[57] ABSTRACT

An adjusting mechanism includes two louvers rotatably provided in an air supply opening of an air conditioner. The louvers have rotating axes parallel to each other, and coupling pins. A coupling arm for rotating the louvers to be interlocked with each other to change inclinations of the louvers is provided. The coupling arm has holes in which the corresponding coupling pins are rotatably inserted. One of the holes is an elongate hole extending along the coupling arm. The coupling pin inserted into the elongate hole is slidable along the elongate hole, thereby allowing independent change of the inclination of one of the louvers.

4 Claims, 9 Drawing Figures

AIR SUPPLY ADJUSTING MECHANISM FOR AIR CONDITIONER

BACKGROUND OF THE INVENTION

The present invention relates to an air supply adjusting mechanism which is provided in an air supply opening of an air conditioner and allows adjustment of air outlet direction and speed.

A ceiling air conditioner, for example, has a housing which can be suspended from a ceiling. An air intake opening is cut in the lower surface of the housing, and an air supply opening is made in the front surface thereof. An air supply adjusting mechanism for adjusting air supply direction is provided in the opening. With this mechanism, air supply can be set to a desired direction in the heating and cooling modes.

The adjusting mechanism has a plurality of louvers pivotally provided at the air supply opening which are coupled to each other by an interlocking member. When one louver is rotated, all the louvers are rotated in the same direction by the interlocking member, thus changing air supply direction. In conventional mechanisms, however, since the louvers are rotated together, they always remain parallel to each other, and the distance between two adjacent louvers is constant. Therefore, conventional mechanisms have a small adjustment margin for air supply direction, and cannot change air supply speed.

SUMMARY OF THE INVENTION

Accordingly, the object of the present invention is to provide an air supply adjusting mechanism for an air conditioner, which has a wide air supply direction adjustment margin and which allows adjustment of the air supply speed.

According to the invention, there is provided an adjusting mechanism which comprises: a plurality of louvers pivotally provided in an air supply opening of an air conditioner; and interlocking means for rotating the louvers to be interlocked with each other so as to change the inclinations of the louvers, the interlocking means having variable means for allowing independent change of the inclination of at least one louver.

BRIEF DESCRIPTION OF THE DRAWINGS

FIGS. 1 to 8 show an adjusting mechanism according to a first embodiment of the present invention, in which: FIG. 1 is a perspective view of an air conditioner provided with the adjusting mechanism, FIG. 2 is a perspective view of the adjusting mechanism, FIG. 3 is an enlarged perspective view showing a portion of the mechanism, and FIGS. 4 to 8 are side views showing the mechanism in different operating states.

DETAILED DESCRIPTION OF THE PREFERRED EMBODIMENTS

An embodiment of the present invention will be described in detail with reference to the accompanying drawings.

Figure 1:
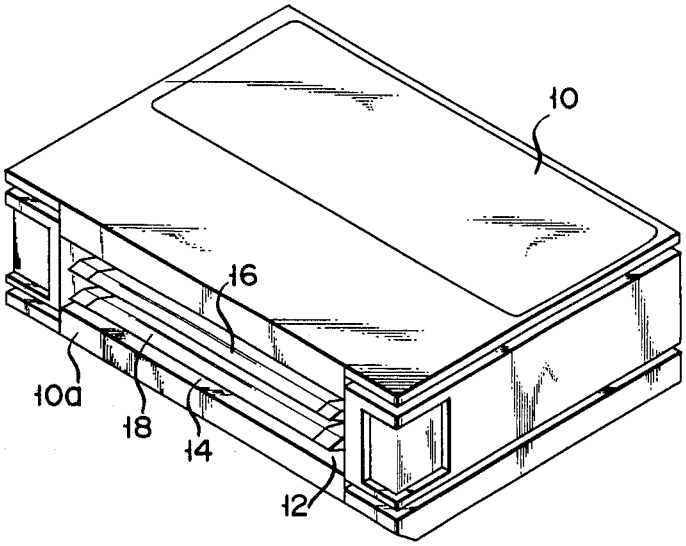

FIG. 1 shows a ceiling air conditioner provided with an adjusting mechanism according to the embodiment of the invention. The air conditioner comprises boxlike housing 10, in which a fan, a heat exchanger (neither are shown), and the like are disposed. Rectangular air supply opening 12 is formed in front surface 10*a* of housing 10, and air supply adjusting mechanism 14 is disposed in opening 12.

Figure 2:
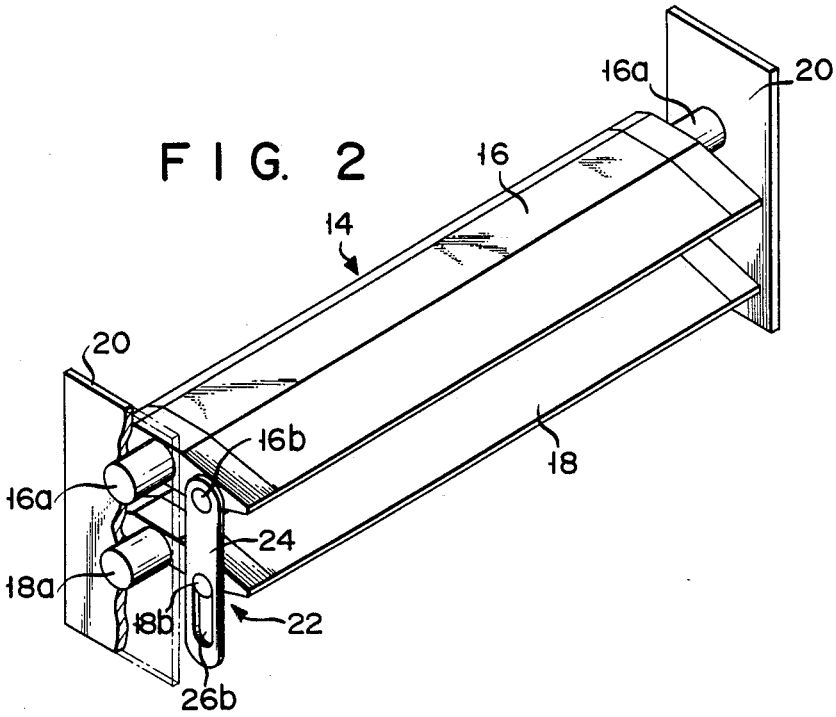

As shown in FIGS. 1 and 2, adjusting mechanism 14 has a pair of elongated louvers 16 and 18 pivotally supported by a pair of parallel end plates 20. Louver 16 has rotating shafts 16*a* extending from two edges thereof, and these shafts are rotatably supported by plates 20. Similarly, louver 18 has rotating shafts 18*a* pivotally supported by plates 20. Shafts 18*a* are supported to be parallel to shafts 16*a*. Shafts 18*a* and 18*b* are inserted in the holes cut in plates 20 and in such a frictional engagement with these plates that louvers 16 and 18 do not rotate under their own weight. Plates 20 are fixed to housing 10 of the air conditioner, and louvers 16 and 18 are disposed in opening 12 to extend along the longitudinal direction thereof.

Figure 3:
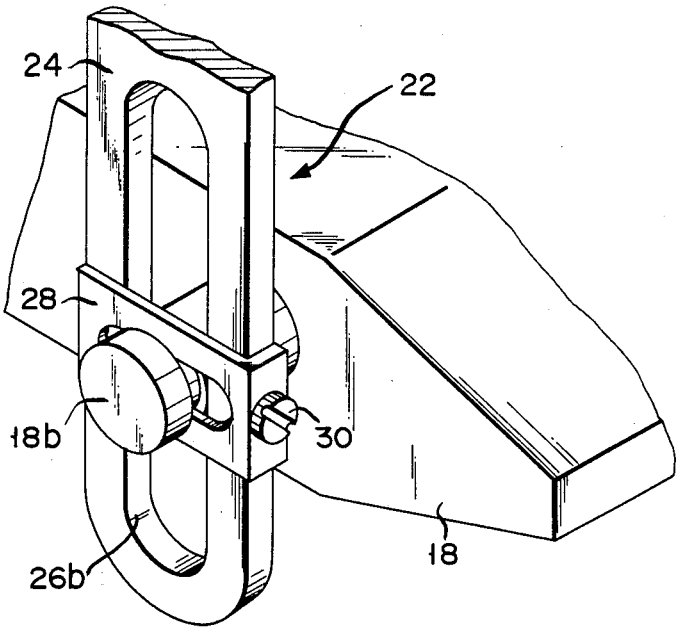
Figure 4:
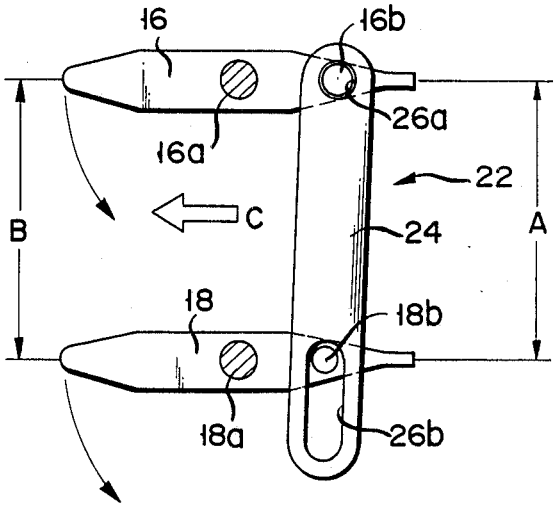

As shown in FIGS. 2 to 4, louvers 16 and 18 are rotated to be interlocked with each other by interlocking mechanism 22, thus being set at a desired inclination. Louver 16 has coupling pin 16*b* extending from one end parallel to shaft 16*a*. Likewise, louver 18 has coupling pin 18*b* extending from one end parallel to shaft 18*a*. Pins 16*a* and 18*b* are separated from shafts 16*a* and 18*a* at an equal distance, and are provided at the same side of the rotating shafts, i.e., at the right side of the rotating shaft in FIG. 4. Interlocking mechanism 22 has coupling arm 24 extending perpendicular to shafts 16*a* and 18*a*. First and second through holes 26*a* and 26*b* are formed in arm 24. Second through hole 26*b* extends for a predetermined length along coupling arm 24. Pin 16*b* of louver 16 is rotatably fitted in hole 26*a*, and pin 18*b* of louver 18 is inserted in hole 26*b* to be rotatable and slidable along coupling arm 24. As shown in FIG. 4, distance A between hole 26*a* and the upper end of hole 26*b* is substantially equal to distance B between shafts 16*a* and 18*a*. When pin 18*b* reaches the upper end of hole 26*b*, louvers 16 and 18 are kept parallel to each other.

As shown in FIG. 3, interlocking mechanism 22 has engaging member 28 for holding pin 18*b* at a desired position within hole 26*b*. Engaging member 28 is mounted on coupling arm 24 to be slidable along the coupling arm, and is engaged with pin 18*b*. When stop screw 30 is screwed in, member 28 can be fixed to coupling arm 24. When member 28 is fixed to arm 24, the slide movement of pin 18*b* in hole 26*b* is restricted and pin 18*b* is held at a specific position relative to arm 24.

The operation of the adjusting mechanism with the above arrangement will now be described.

In FIG. 4, pin 18*b* of louver 18 is positioned at the upper end of hole 26*b*, and louvers 16 and 18 are in a horizontal state. The direction of air supply in this state is indicated by the arrow C.

Figure 5:
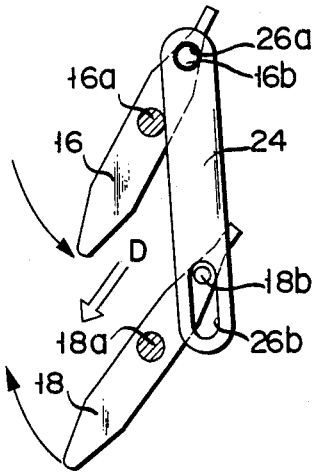

When louver 18 is rotated downward, i.e., counterclockwise from the state shown in FIG. 4, coupling arm 24 is pushed up by pin 18*b*, as shown in FIG. 5. Pin 16*b* of louver 16 is then pushed up by arm 24, and louver 16 is rotated in the same direction as louver 18. In this way, louvers 16 and 18 are directed downward parallel to each other, and air is supplied in the direction indicated by the arrow D.

Figure 6:
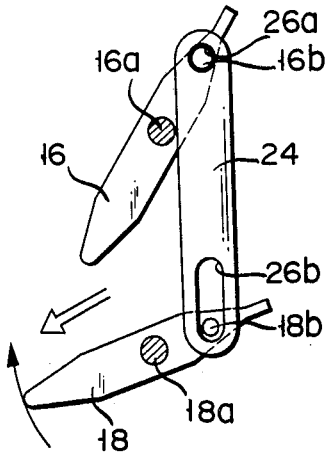
Figure 7:
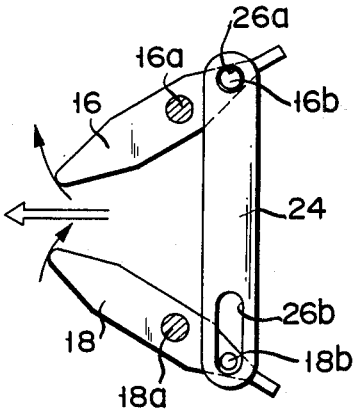
Figure 8:
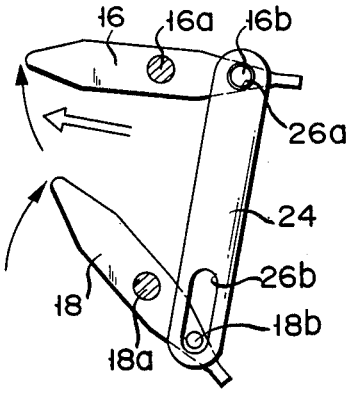

When lower louver 18 is rotated clockwise as shown in FIG. 6, pin 18*b* moves downward within hole 26*b*. Pin 18*b* does not transmit the rotational force of louver 18 to arm 24 until it abuts against the lower end of hole 26. For this reason, the inclination of lower louver 18 can be adjusted without changing that of upper louver 16. Since louvers 16 and 18 are not parallel to each other, the distance between them is decreased. After pin 18*b* abuts against the lower end of hole 26*b*, when louver 18 is further rotated clockwise, louver 16 is rotated clockwise, as shown in FIG. 7. After upper louver 16 is rotated clockwise to obtain a horizontal state as shown in FIG. 8, when louver 18 is rotated until pin 18*b* abuts against the upper end of hole 26*b*, louver 18 can be in a horizontal state. Thus, the initial state shown in FIG. 4 is arrived at.

With the adjusting mechanism having the above arrangement, when one louver is rotated, the other louver can be rotated to be interlocked therewith through coupling arm 24, thus freely setting air supply direction. When louver 18 alone is rotated so as to change the inclination between louvers 16 and 18, the distance between the louvers, i.e., the area of the air supply opening can be decreased, as shown in FIGS. 6 to 8. Air supply speed is thereby increased, and air travels farther.

FIGS. 4 to 8 show movement of louvers 16 and 18 when engaging member 28 is freely slidable. When louvers 16 and 18 are rotated while member 28 is fixed at a desired position of arm 24, inclination combinations different from those shown in FIGS. 4 to 8 can be realized.

The present invention is not limited to the above embodiment, and various changes and modifications may be made within the spirit and scope of the invention.

Figure 9:
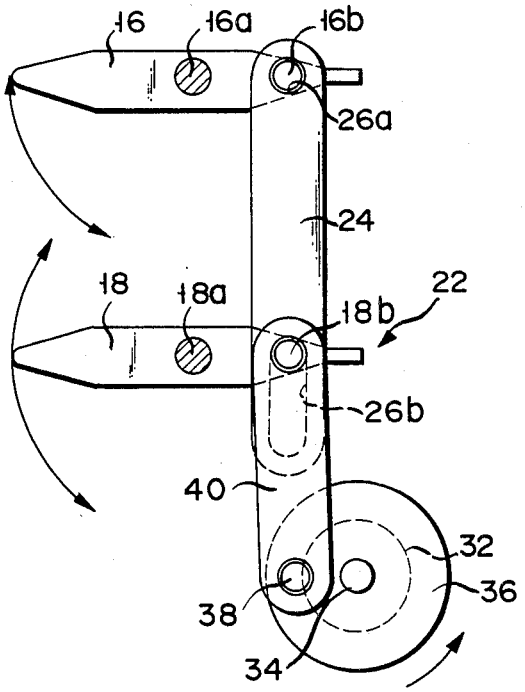
FIG. 9 is a side view showing an adjusting mechanism according to a second embodiment of the present invention.

For example, instead of being manually rotated, louvers 16 and 18 can be driven by a motor, as shown in FIG. 9.

Interlocking mechanism 22 comprises motor 32 whose rotating shaft 34 is coaxially fixed to rotating plate 36. Engaging pin 38 extends from plate 36 to be eccentric to shaft 34. Engaging pin 38 and coupling pin 18*b* of louver 18 are coupled by drive arm 40. Other arrangements are the same as in the first embodiment, and a detailed description thereof will be omitted.

When motor 32 and plate 36 are rotated, arm 40 is reciprocated vertically, thereby continuously rotating louver 18. Thus, the inclinations of louvers 16 and 18 are continuously changed. When motor 32 is stopped, louvers 16 and 18 can be fixed to desired positions.

The adjusting mechanism of the present invention can be applied not only to a ceiling air conditioner but also to other types of air conditioner (e.g., window or floor models). The number of louvers is not limited to two but can be increased as needed. In this case, the number of elongate through holes made in the coupling arm, in which the coupling pins of the louvers are inserted, is not limited to one, but can be two or more.

What is claimed is:

1. An adjustng mechanism for adjusting the direction and speed of an air supply opening of an air conditioner, comprising;

a plurality of louvers rotatably provided in the air supply opening and having rotating axes parallel to each other, each of said louvers having a coupling pin; and interlocking means for rotating said louvers to be interlocked with each other, so as to change the inclinations of said louvers, said interlocking means having variable means for allowing independent changing of the inclination of at least one louver and a coupling arm extending in a direction perpendicular to said rotating axes of said louvers, said coupling arm having a plurality of holes in which the corresponding coupling pins are rotatably inserted, at least one of said holes being an elongated hole extending in an axial direction of said coupling arm, and said elongated hole forming said variable means.

2. A mechanism according to claim 1, wherein said interlocking means includes an engaging member mounted on said coupling arm to be slidable along the axial direction thereof and engaged with said coupling pin inserted in said elongated hole, and a stopper for fixing said engaging member to said coupling arm so as to restrict slide movement of said coupling pin within said elongated hole.

3. A mechanism according to claim 1, wherein said interlocking means has driving means for continuously moving said coupling pin inserted in said elongated hole.

4. A mechanism according to claim 3, wherein said driving means has a motor, a rotating plate fixed to the rotating shaft of said motor, an engaging pin fixed to said rotating plate to be eccentric to said rotating shaft of said motor, and a drive arm coupling said coupling pin inserted in said elongated hole and said engaging pin.

* * * * *